United States Patent [19]

Miller

[11] Patent Number: 4,610,899

[45] Date of Patent: Sep. 9, 1986

[54] ROSETTE RIBBON AND METHOD FOR MAKING THE SAME

[76] Inventor: Calvin E. Miller, 200 N. Water St., Ligonier, Ind. 46767

[21] Appl. No.: 781,947

[22] Filed: Sep. 30, 1985

[51] Int. Cl.[4] ..... A44C 3/00

[52] U.S. Cl. ..... 428/4; 156/222

[58] Field of Search ..... 428/4, 79, 542.2; 28/150; 156/222

[56] References Cited

U.S. PATENT DOCUMENTS

| | | | |
|---|---|---|---|
| 1,587,294 | 6/1926 | Gallagher | 428/4 X |
| 2,547,676 | 4/1951 | Updike | 428/913.3 X |
| 2,729,009 | 1/1956 | Markus et al. | 428/79 X |
| 2,886,912 | 5/1959 | Rowland | 428/5 |
| 2,910,794 | 11/1959 | Lockridge | 428/4 |
| 3,256,129 | 4/1962 | Wallerstein et al. | 428/5 |
| 3,501,364 | 3/1970 | Rowland | 428/5 |
| 4,160,685 | 7/1979 | Kuroda | 428/79 X |
| 4,339,059 | 7/1982 | Kenyon | 428/5 |
| 4,376,812 | 3/1983 | West | 428/165 |
| 4,525,393 | 6/1985 | DiCostanzo | 428/913.3 X |

FOREIGN PATENT DOCUMENTS 663271 1/1949 United Kingdom .

*Primary Examiner*—Henry F. Epstein

*Attorney, Agent, or Firm*—Albert L. Jeffers; Anthony Niewyk

[57] ABSTRACT

A rosette ribbon including a base layer which is formed by compressing a compressible binder impregnated polyester-fiber material. A cover layer of satin ribbon acetate is bonded to the base layer. A second cover layer of satin ribbon acetate may also be provided, the second layer having certain portions removed whereby portions of the first cover layer are exposed. The assembly is also provided with streamers and a cardboard backing material. The ribbon head including the base layer and cover layer is formed in a heated die which includes a female die member and a resilient rubber base. The resulting ribbon head will have convex portions to give it a three dimensional appearance.

14 Claims, 4 Drawing Figures

ROSETTE RIBBON AND METHOD FOR MAKING THE SAME

BACKGROUND OF THE INVENTION

This invention relates to rosette ribbons, ribbon badges and the like and a method for making the same. Specifically this invention relates to laminar rosette ribbons which are made of layers of material and which are made by pressing in a die.

Prior art rosettes have generally been constructed from pleated or looped ribbons, such ribbons comprising textile material such as rayon, nylon, acetate, silk and the like. The ribbon heads are formed by pleating or looping a ribbon either by hand or on specially designed machines. The pleated or looped ribbon is secured to a backing to give rigidity to the ribbon head structure. One or more ribbons or streamers are then secured to the ribbon head to form the finished rosette ribbon.

One example of such a prior art rosette ribbon and the method for making it is disclosed in U.S. Pat. No. 1,587,294. In this particular construction the rosette or badge is made in the form of a flower. The flower is made by folding the ribbon and securing the edges of the material by stitching them together with a thread. The rosette ribbon head petals are made by folding a number of ribbons and stitching the folds together. Finally, after the entire ribbon head has been made a plurality of ribbon streamers are attached thereto.

Methods have also been provided in the prior art for manufacturing appliques and the like and wherein a resilient compressible thermoplastic layer of material is located between a decorative surface layer and a base layer. Such appliques are made by bonding the surface layer to the base layer in selected areas by compression of the resilient thermoplastic material which is located between the surface layer and the base layer. In these applique structures not the entire thermoplastic compressible layer is compressed. Rather the thermoplastic layer is compressed only in selected areas or zones whereby the surface layer is bonded to the thermoplastic layer and to the base layer in these selected areas. In the remaining areas located between these bonded areas the thermoplastic material remains resilient and uncompressed whereby the applique includes resilient compressible padded areas. The resultant structure therefore comprises a raised resilient design which is filled with a padding layer thus producing a resilient padded three dimensional applique article. Such an article is inherently flexible and would be unsuitable for use as a rosette because it would not have sufficient inherent rigidity nor would it have the desired appearance of a rosette ribbon. It is therefore desired to produce a rosette ribbon which has the appearance of a three dimensional article but which is inherently rigid and self supporting.

The rosette ribbons constructed in accordance with the prior art methods were both complicated and expensive due to the cost of the materials involved as well as the cost of the labor required to make the rosette. It is therefore desired to provide a rosette ribbon which is simple and inexpensive to construct, uses a relatively small amount of material and is pleasing and attractive.

It is furthermore desired to provide a method for manufacturing a rosette which is versatile whereby a variety of sizes of rosettes can be manufactured by the same method. Lastly, it is desired to produce a rosette which is not only low in cost but which is sturdy and durable.

SUMMARY OF THE INVENTION

The present invention, overcomes the disadvantages of the above described prior art rosette ribbons and methods for making them by providing an improved rosette ribbon and a method for making the rosette ribbon.

The method for making the rosette ribbon, in one form thereof, comprises the steps of compressing in a die a base layer of compressible, binder impregnated thermoplastic material together with a cover layer of textile ribbon material. The layers are compressed for a predetermined amount of time at a preselected temperature and pressure to shape the layers, to compress the entire compressible base layer and to bond the compressible base layer to the ribbon cover layer. The entire base layer is compressed thereby causing it to conform to the female die and to become relatively rigid and self supporting. The cover layer is also shaped to conform to the female die and is stretched thereby. During pressing the cover layer will also be bonded to the base layer. After a predetermined period of time the die is opened and the bonded shaped ribbon head is removed from the die. One or more streamers are attached to the ribbon head and a rigid backing material may be attached to the back of the ribbon head to give it further rigidity.

One advantage of the construction according to the instant invention is that the ribbon head which is formed of the shaped compressed base layer and the shaped cover layer is self-supporting.

A further advantage of the method according to the instant invention is that the ribbon head is simple in construction yet is attractive and durable.

A still further advantage of the method according to the instant invention is that the method lends itself to the forming of rosettes having a variety of colors and color combinations.

Another advantage of the instant invention is that a ribbon head constructed in accordance with the method of the instant invention is low in cost yet is very decorative and attractive.

Yet another advantage of the method according to the instant invention is that the ribbon head may be manufactured relatively rapidly and uses a relatively small amount of material.

The present invention, in one form thereof, comprises a method for making a rosette ribbon comprising the steps of providing a first cover layer, providing a base layer of compressible binder impregnated thermoplastic material and superimposing the cover layer on the base layer. A resilient pad is provided and the superimposed layers are placed between a female die member having a die cavity therein and the resilient pad. The resilient pad is pressed against the superimposed layers and the die member to deform the layers and to force them into the die cavity, thereby compressing the entire base layer and bonding the first cover layer to the base layer.

The present invention, in one form thereof, further comprises a decorative rosette ribbon including a laminated ribbon head comprising a base layer formed by compressing a compressible thermoplastic material impregnated with a binder and a first cover layer which is bonded to the compressed layer. The base and cover layer include convex portions which are raised from the base plane of the ribbon head.

The present invention, in one form thereof, still further comprises a rosette including a first layer of satin ribbon acetate material, a base layer of compressed polyester fiber material which is impregnated with a binder and wherein the base layer is bonded to the first layer. The bonded base and first layer have convexly deformed portions. A plurality of streamers and a rigid support member are secured to the base layer.

It is an object of the instant invention to provide a rosette ribbon head which is low in cost yet is attractive and decorative.

It is another object of the instant invention to provide a method for making a rosette ribbon which is versatile whereby a variety of rosette ribbons may be constructed which are durable yet attractive and low in cost.

Still another object of the instant invention is to provide a method for making a ribbon rosette using a minimum of material and time yet providing a very attractive and decorative ribbon rosette.

BRIEF DESCRIPTION OF THE DRAWINGS

The above mentioned and other features and objects of this invention and the manner of obtaining them will become more apparent and the invention itself will be better understood by reference to the following description of an embodiment of the invention taken in conjunction with the accompanying drawings, wherein.

Corresponding reference characters indicated corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
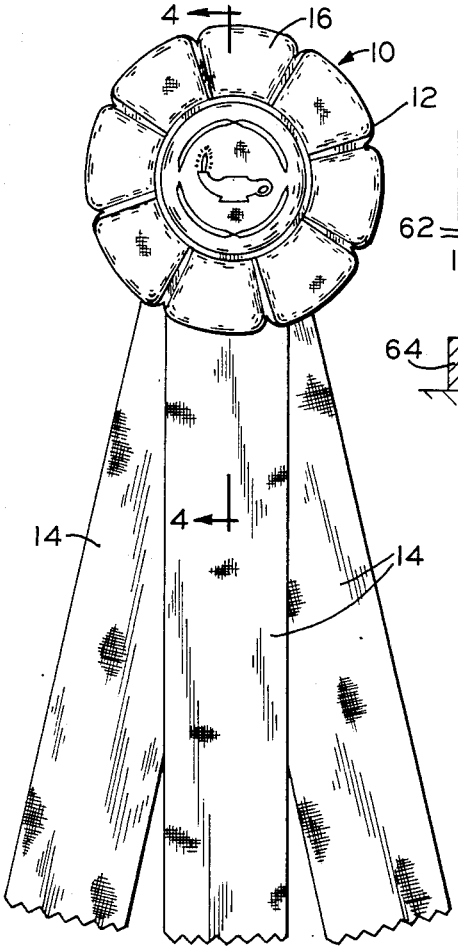
FIG. 1 is a front elevational view of a ribbon rosette.
Figure 2:
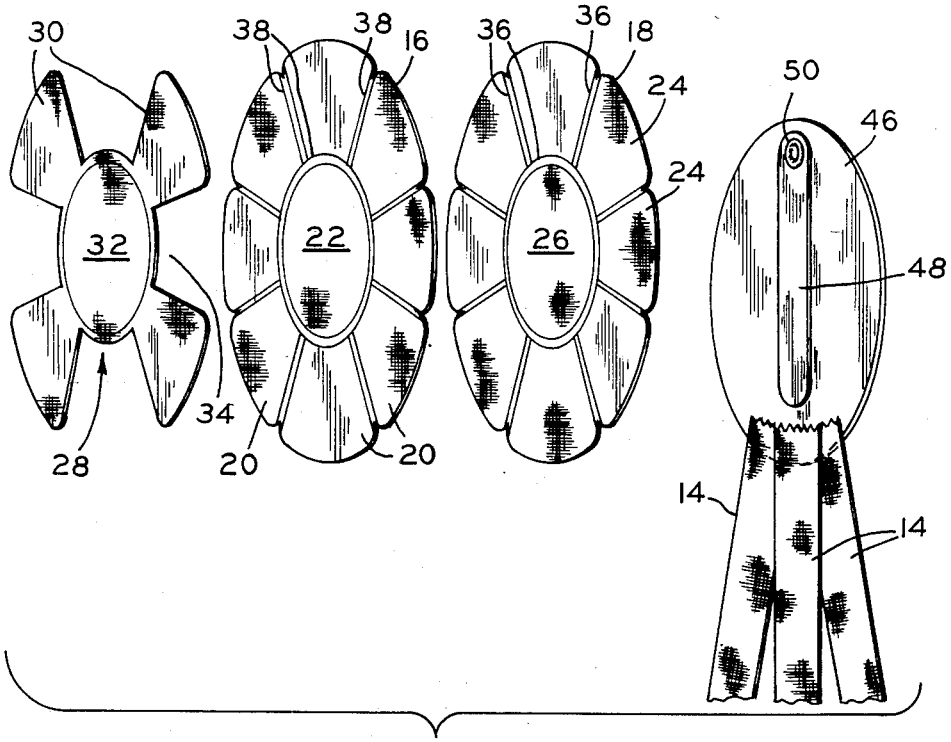
FIG. 2 is an exploded view of the ribbon rosette.

Referring to FIGS. 1 and 2, a rosette assembly 10 is shown including a rosette ribbon head 12 and a plurality of streamers or ribbons 14. The ribbon head 12 includes a first cover layer 16 and a base layer 18. Cover layer 16 is preferably constructed of a satin ribbon acetate material of a desired color. Base layer 18 preferably comprises a Denier polyester fiber material impregnated with a binder. This material is compressible and resilient in the uncompressed state and is commercially available from Sackner Products Company of Grand Rapids, Mich. As will be further explained hereinafter, cover layer 16 includes rosette petal portions 20 and a central portion 22. Base layer 18 includes petal portions 24 and a central portion 26. In addition a second cover layer 28 is provided including petal portions 30 and central portion 32. The second cover layer 28 is preferably of a different color than cover layer 16. As can be clearly seen, alternate petals 30 have been removed from cover layer 28. Second cover layer 28 therefore covers cover layer 16 only partially whereby a desired color pattern of layers 16 and 28 is generated. When the base layer 18 and the first and second cover layers 16 and 28 are assembled as shown in FIG. 1, the bonding lines 36 of base layer 18 and bonding lines 38 of first cover layer 16 will coincide. Bonding lines 36 and 38 are formed during the pressing operation in a die as will be further explained hereinafter.

Figure 4:
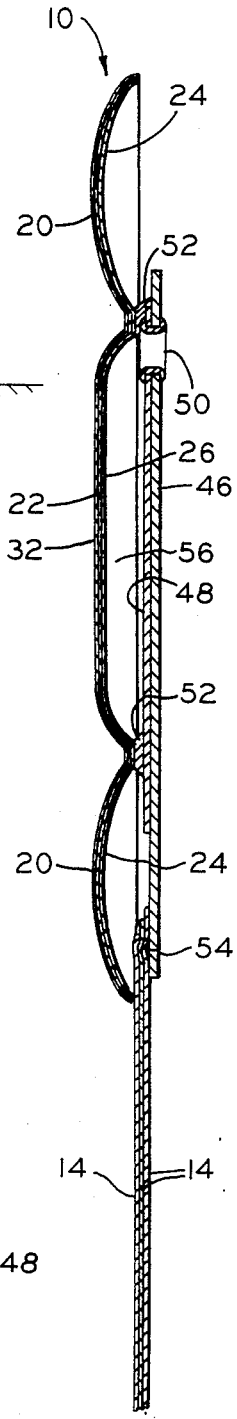
FIG. 4 is an enlarged sectional view of the rosette taken along the line 4—4 of FIG. 1.

The rosette ribbon head construction is completed by means of gluing a backing member 46 thereto with glue strips 52. Member 46 which is preferably constructed of cardboard or another suitable rigid material and to which is riveted by means of an eyelet 50 a rigid metal strip 48 to provide additional rigidity for the completed ribbon head assembly. Additionally, ribbons 14 are glued to backing material 46 which is in turn glued to the base and cover layer assembly my means of a strip of glue 54 as best shown in FIG. 4.

Figure 3:
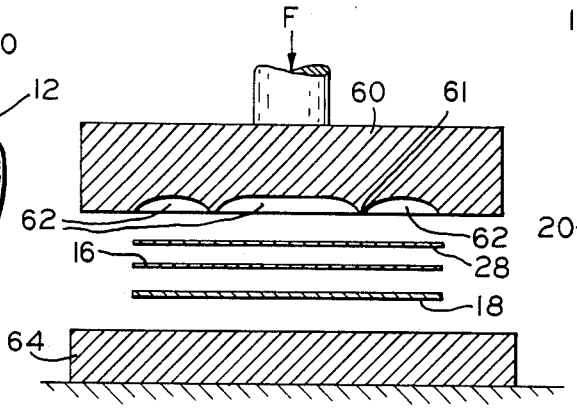
FIG. 3 is a front elevational view of the die assembly including the ribbon rosette parts.

Referring now to FIG. 3 the assembly is formed as follows. An etched female die member 60 is provided including die cavities 62 which conform in shape to the desired shape of the laminated structure consisting of base layer 18 and cover layers 16 and 28. The depth of the die cavities is chosen so that the completed laminated rosette ribbon head assembly has sufficient rigidity and is pleasing in appearance. Since the satin acetate cover layers 16 and 28 are flat, in their unformed condition, when the die is closed the acetate material will be deformed and stretched to conform to the shape of the die member 60. The amount of "give" or "stretch" which is available in the acetate material is limited, thereby limiting the depth of the cavity. Therefore care should be taken that the die cavity is not too deep since this would cause the acetate cover layers 16 and 28 to be deformed too much so that they will tear. However, if the cavity is not deep enough the finished ribbon head will not have the desired three dimensional appearance and will not have the desired rigidity. In the preferred embodiment the depth of cavity 62 will be $\frac{1}{8}$th of an inch.

A heated resilient rubber pad 64 is provided so that, when die member is forced downwardly, the rubber pad material will be deformed and will fill the die cavities thereby causing layers 16, 18 and 28 to conform exactly to the shape of the die cavity. Base layer 18 will be compressed and the binder material will melt and will cause the fibers of the polyester material to be bonded together. Additionally the binder material will cause the cover layer to adhere to the base layer. The regions 61 between the die cavities will form bonding lines 36 and 38 since the pressure on the laminar layers 16, 18 and 28 is greatest in these regions and the greatest amount of bonding therefore occurs along these lines.

The temperature of pad 64 is preferably in the range of 375° F. to 425° F. for best results. If too high a temperature is chosen the color of the acetate material may change which is undesirable as the acetate ribbon head material will then not match the ribbon streamers 14.

In a preferred embodiment, in order to provide adequate bonding, the pressure at which the die is operated is in the range of 1000 to 2000 lbs. for a six cavity die wherein six ribbon heads are formed simultaneously. At the indicated pressures and temperature the die will preferably be closed for approximately 10 seconds for best results. When the ribbon head is removed from the die and cools down the binder material will solidify and the entire assembly will become relatively rigid.

It should be understood that other combinations of pressure, temperature, and die operating times may be used. However, these three factors must be balanced properly to form a satisfactory rosette ribbon head.

It can therefore be seen that, by means of the disclosed process, a ribbon head is formed wherein the base layer material 18, which in its uncompressed state is resilient, will be completely compressed and bonded whereby it becomes rigid as the binder material binds the fibers of the thermoplastic material tightly together. The assembly will have additional rigidity because of the scalloped three dimensional shape including the raised or convex portions such as petals 24 and central portion 26. As can be clearly seen in FIG. 4 the entire assembly is very compact and the base and cover layers each confirm exactly to the shape of the die cavity. Space 56 is formed between the cardboard backing member 56 and base layer 18. The base layer therefore forms a relatively rigid backing material for the relatively flexible acetate cover layer 16 and 28. While the rosette ribbon head could be used in this form without an additional backing member, member 46 provides additional rigidity and permits the attachment of an eyelet 50 so that the rosette may be attached. By using a second cover layer 28 wherein several pedals have been removed a very attractive decorative rosette can be formed whereby alternating petals of the finished rosette will be different colors. After formation of the ribbon head the central portion 32 of the outer cover layer may be imprinted with writing by means of any suitable process such as a conventional hot pressing process.

While it is possible to use only a single cover layer 16, this would result in a rosette ribbon having a single color. This may be preferred for some applications. However, in other applications two or more colors may be desired and therefore two or more layers of cover material would be used. It is also possible to use streamers of different colors as desired.

While this invention has been described as having a preferred design, it will be understood that it is capable of further modification. This application is therefore intended to cover any variations, uses, or adaptations of the invention, following the general principles thereof and including such departures from the present disclosure as come within known or customary practice in the art to which this invention pertains and fall within the limits of the appended claims.

What is claimed is:

1. The method for making a rosette ribbon head comprising the steps of:

providing a first cover layer;

providing a base layer of compressible binder impregnated thermoplastic fiber material;

superimposing said cover layer on said base layer;

providing a heated resilient pad;

placing said superimposed layers between a female die member having a patterned die cavity therein and said resilient pad;

relatively moving said resilient pad and said die to thereby press said superimposed layers between said resilient pad and said die to deform said layers and force said layers into said die cavity, thereby compressing said entire base layer, bonding said first cover layer to said base layer and forming a ribbon head in the pattern of said die cavity; and removing said ribbon head from said die cavity.

2. The method according to claim 1 wherein said heated resilient pad is at a temperature in the range of 375° F. to 425° F.

3. The method according to claim 1 including the step of securing a rigid backing member to said base layer.

4. The method according to claim 1 including the step of securing ribbon streamers to said ribbon head.

5. A decorative rosette ribbon including a laminated ribbon head comprising:

a base layer formed by compressing a compressible thermoplastic fiber material impregnated with a binder into a patterned die cavity;

a first cover layer bonded to said patterned compressed base layer;

said patterned, bonded base layer and cover layer including convex portions, which are raised from the base plane of said ribbon head.

6. The rosette ribbon according to claim 5 wherein said base layer comprises a binder impregnated polyester fiber material.

7. The rosette ribbon according to claim 5 wherein said first cover layer comprises satin ribbon acetate.

8. The rosette ribbon according to claim 5 including a second cover layer overlying said first cover layer, said second cover layer having a different color than said first cover layer and having portions thereof removed whereby portions of said first cover layer are exposed to form a multicolored rosette ribbon head.

9. The rosette ribbon according to claim 8 wherein said first and second cover layers comprise satin ribbon acetate.

10. The rosette ribbon according to claim 5 including a support member secured to said base layer.

11. The rosette ribbon according to claim 10 including a plurality of streamers secured to said support member and said base layer.

12. The article according to claim 10 wherein said support member comprises a rigid cardboard member.

13. A rosette comprising:

a first layer of satin ribbon acetate material;

a base layer of compressed polyester fiber material impregnated with a binder;

said base layer being bonded to said first layer;

said bonded base and first layer having patterned convexly deformed portions;

a plurality of streamers secured to said base layer; and a rigid support member secured to said base layer.

14. The rosette according to claim 12 including a second cover layer overlying said first layer, said second cover layer being of a different color than said first layer and having portions thereof removed, whereby portions of said first layer are exposed to form a multicolored rosette ribbon head.

* * * * *